United States Patent [19]

Ashok et al.

[11] Patent Number: 4,907,639

[45] Date of Patent: Mar. 13, 1990

[54] ASYMMETRICAL GAS-ATOMIZING DEVICE AND METHOD FOR REDUCING DEPOSITE BOTTOM SURFACE POROSITY

[75] Inventors: Sankaranarayanan Ashok, Bethany; Thomas J. Melillo, East Haven, both of Conn.

[73] Assignee: Olin Corporation, Cheshire, Conn.

[21] Appl. No.: 322,434

[22] Filed: Mar. 13, 1989

[51] Int. Cl.[4] ..... B22D 23/00

[52] U.S. Cl. ..... 164/46; 118/302; 427/422; 239/214

[58] Field of Search ..... 164/46; 427/422, 423; 118/302; 239/214, 499, 380

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. | 117/38 |
| 2,972,185 | 2/1961 | Brennan | 29/420.5 |
| 3,608,615 | 9/1971 | Conlon | 164/87 |
| 3,727,672 | 4/1973 | Grenfell . | |
| 3,742,585 | 7/1973 | Wentzell | 29/423 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 4,064,295 | 12/1977 | Singer | 239/297 |
| 4,512,384 | 4/1985 | Sendzimir | 164/46 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | | |
|---|---|---|---|
| 0225732 | 6/1987 | European Pat. Off. . | |
| 0225080 | 10/1987 | European Pat. Off. . | |
| 214303 | 10/1984 | German Democratic Rep. | 239/290 |
| 1379261 | 2/1975 | United Kingdom . | |
| 1472939 | 5/1977 | United Kingdom . | |
| 2007129 | 5/1979 | United Kingdom . | |
| 1548616 | 7/1979 | United Kingdom . | |
| 1599392 | 9/1981 | United Kingdom . | |
| 2172827 | 10/1986 | United Kingdom . | |
| 2172900 | 10/1986 | United Kingdom . | |

OTHER PUBLICATIONS

R. W. Evans et al., "The Osprey Preform Process", 1985, pp. 13–20 *Powder Metallurgy*, vol. 28, No. 1.

A. G. Leatham et al., "The Osprey Process For The Production Of Spray–Deposited Roll, Disc, Tube and Billet Preforms", 1985, pp. 157–173, *Modern Developments In Powder Metallurgy*, vols. 15–17.

*Primary Examiner*—Kuang Y. Lin

[57] ABSTRACT

A molten metal gas-atomizing spray-depositing apparatus employs an asymmetrical gas-atomizing device for generating one-sided shear forces for breaking-up and atomizing a stream of molten metal into metal particles in a divergent spray pattern of higher mass density at an upstream leading peripheral portion of the spray pattern, relative to the direction of movement of a substrate, than either of a center region or downstream trailing peripheral region of the pattern.

19 Claims, 2 Drawing Sheets

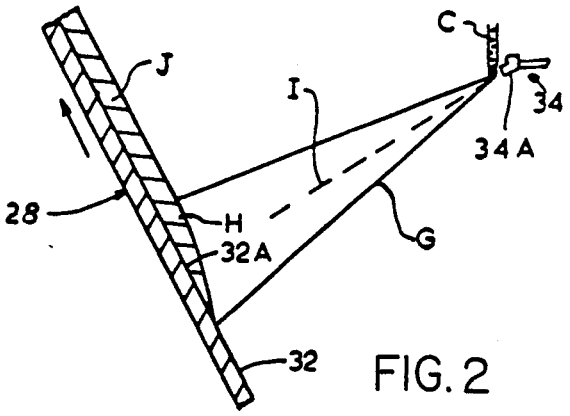
FIG. 2
FIG. 4
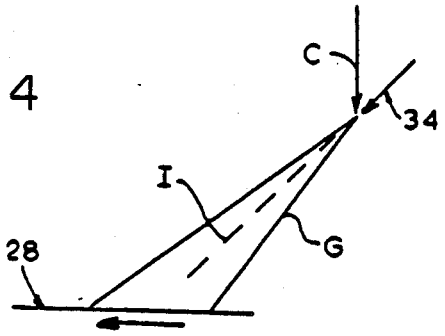
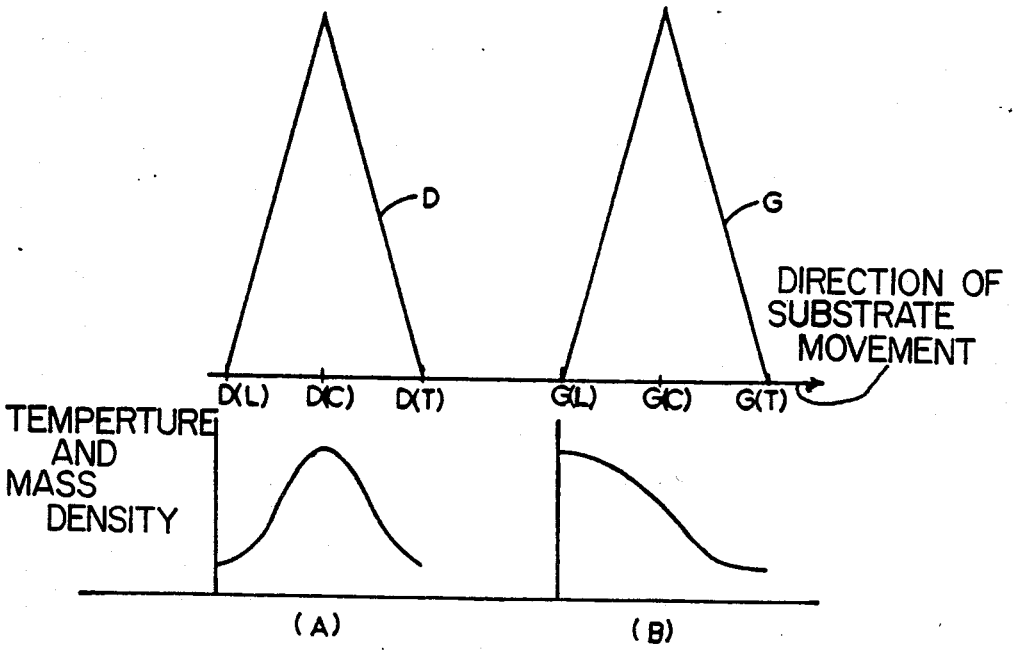
FIG. 3

ASYMMETRICAL GAS-ATOMIZING DEVICE AND METHOD FOR REDUCING DEPOSITE BOTTOM SURFACE POROSITY

Reference is hereby made to the following copending U.S. patent application dealing with related subject matter and assigned to the same assignee of the present invention: "Substrate Orientation in a Gas-Atomizing Spray-Depositing Apparatus" by H. P. Cheskis, W. G. Watson and S. Ashok, assigned U.S. Ser. No. 246,711 and filed Sept. 20, 1988.

The present invention generally relates to spray-deposited production of a product on a moving substrate and, more particularly, is concerned with a device and method for asymmetrically gas-atomizing a molten metal stream to produce a spray of metal particles providing an improved distribution of temperature through the deposit cross-section and reduced bottom surface porosity in the deposit.

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process" by R.. Evans et al, *Powder Metallurgy*, Vol. 28, No. 1 (1985), pages 13–20 and "The Osprey Process for the Production of Spray-Deposited Roll, Disc, Tube and Billet Preforms" by A.G. Leatham et al, *Modern Developments in Powder Metallurgy*, Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in U.S. Pat. No. 3,775,156 and European Pat. Appln. No. 225,080. For producing these products, a substrate or collector, such as a flat substrate or an endless belt, is moved continuously through the spray to receive a deposit of uniform thickness across its width.

Heretofore, extensive porosity typically has been observed in a spray-deposited preform at the bottom thereof being its side in contact with the substrate or collector. This well known phenomenon, normally undesirable, is a particular problem in a thin gauge product, such as strip or tube, since the porous region may comprise a significant percentage of the product thickness. The porosity is thought to occur when the initial deposit layer is cooled too rapidly by the substrate, providing insufficient liquid to feed the inherent interstices between splatted droplets.

In the production of strip by the Osprey process, a gas-atomizing device is typically used. As disclosed in the above-cited U.S. Pat. No. 3,775,156 and European Pat. Appln. No. 225,080, the gas-atomizing device can be a symmetrical arrangement of jets or, alternatively, a single annular-shaped gas opening or annulus, surrounding the stream of molten metal. The gas-atomizing device converts the molten metal stream into a divergent spray cone of molten metal particles. The bottom surface porosity of the strip originates from the low mass density of particles in the leading region of the spray cone. Insufficient atomized particles are supplied in this region of the spray to maintain sufficient liquid to fill voids even when the center region of the spray is optimally producing high density interior structure in the deposit.

One approach of the prior art for eliminating these problems is preheating the substrate to minimize or reduce the rate of heat transfer from the initial deposit to the substrate so that some fraction liquid is always available to feed voids created during the spray deposition process. However, it is often difficult to effectively preheat a substrate in a commercial spray deposit system because of the cooling effects of the high velocity recirculating atomizing gas. Further, preheating a substrate increases the potential for the deposit sticking to the substrate. Therefore, a need exists for an alternative approach to elimination of the porosity problem particularly in thin gauge product produced by the above-described Osprey spray-deposition process.

The present invention provides an asymmetrical gas-atomizing device and method designed to satisfy the aforementioned needs. The asymmetrical gas-atomizing device generates one-sided shear forces for breaking up a molten metal stream into a spray cone of metal particles having an improved, more uniform, distribution of temperature through the deposit cross-section and reduced bottom surface porosity in the deposit.

The gas-atomizing device of the present invention asymmetrically, relative to the central axis of the molten metal stream, impacts and breaks up the stream from one side of the stream. By comparison, the prior art gas-atomizing device symmetrically, relative to the central axis of the molten metal stream, impacts and breaks up the stream from all sides or directions about the stream.

The asymmetrical gas-atomizing device of the present invention thus produces a divergent spray cone whose central axis projects angularly away from the central axis of the vertical stream. As a result of gravity, more molten metal particles will segregate to the bottom, or leading region, of the spray cone. On the other hand, the prior art symmetrical gas-atomizing device produces a divergent spray cone whose central axis projects coincident with the central axis of the vertical stream with more of the molten particles located centrally in the middle of the spray cone. Hence, the asymmetrical gas-atomizing device would provide a higher fraction of liquid in the initial deposits and closer to the substrate than the prior art symmetrical gas-atomizing device, thus promoting improved temperature distribution through the cross-section of the deposit and minimal porosity in the bottom surface of the deposit.

These and other features and advantages of the present invention will become apparent to those skilled in the art upon a reading of the following detailed description when taken in conjunction with the drawings wherein there is shown and described an illustrative embodiment of the invention.

In the course of the following detailed description, reference will be made to the attached drawings in which:

FIG. 2 is a fragmentary schematic elevational view, partly in section, of one modified form of the spray-deposition apparatus employing an asymmetrical gas-atomizing device in accordance with the present invention.

FIG. 3 is a graph comparing the respective temperature distributions across the spray cones produced by the prior art symmetrical gas-atomizing device and the asymmetrical gas-atomizing device of the present invention.

FIG. 4 is a fragmentary schematic elevational view, of another modified form of the spray-deposition apparatus employing the gas-atomizing device of the present invention.

Figure 1:
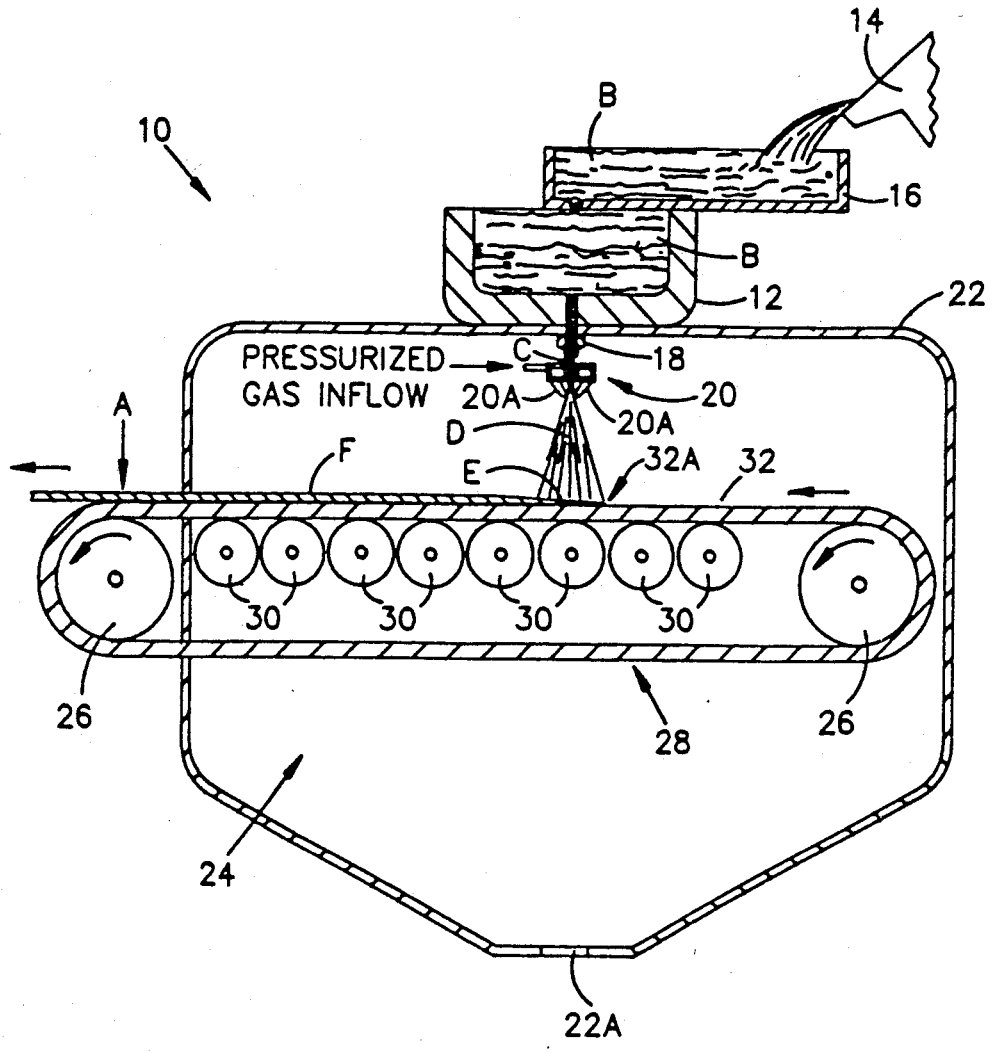
FIG. 1 is a schematic view, partly in section, of a prior art spray-deposition apparatus for producing a product on a moving substrate, such as in thin gauge strip form.

Referring now to the drawings, and particularly to FIG. 1, there is schematically illustrated a prior art spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12.

Also, a gas-atomizing device 20 employed by the apparatus 10 is positioned below the tundish bottom nozzle 18 within a spray chamber 22 of the apparatus 10. The atomizing device 20 is supplied with a gas, such as nitrogen, under pressure from any suitable source. The gas-atomizing device 20 which surrounds the molten metal stream C has a plurality of jets 20A symmetrically positioned about the stream C. The atomizing gas is thereby impacted or impinged on the stream from all sides and directions about the stream so as to convert the stream into a spray D of atomized molten metal particles, broadcasting downwardly from the atomizing device 20 in the form of a divergent conical pattern. If desired, the atomizing device 20 can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizing device 20. The substrate system 24 includes drive means in the form of a pair of spaced rolls 26, an endless substrate 28 in the form of a flexible belt entrained about and extending between the spaced rolls 26, and support means in the form of a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product P.

The atomizing gas flowing from the atomizing device 20 is much cooler than the solidus temperature of the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles overspray the substrate 28, solidify and fall to the bottom of the spray chamber 22 where they along with the atomizing gas flow from the chamber via an exhaust port 22A.

The mass density and temperature distribution or profile of the gas-atomized metal of the prior art divergent pattern of spray D is bell-shaped across the pattern. Typically, as shown in the graph (A) of FIG. 3, the center region D(C) of the prior art divergent spray pattern D is of higher temperature (and also of higher mass density) than the periphery or outer fringe regions of the spray pattern D(L) and D(T). Because of the divergent configuration of the prior art spray pattern D and orientation of the substrate 28 relative thereto, the particles in the outer fringe regions thereof have to move through a greater distance to reach the horizontal substrate than particles in the center region thereof.

The porosity problem observed in the bottom surface of the strip F derives from the cooler, low mass density outer fringe regions of the prior art spray pattern D. In effect, this low mass density fringe region supplies insufficient atomized particles to maintain sufficient liquid to fill voids even when the center region of the spray pattern D is optimized and is producing high density interior structure in the deposit E.

The overall result is a generally non-uniform temperature distribution through the cross-section of the deposit E. Particularly, referring to FIG. 3, the inner portion of the deposit E formed by the leading region D(L) of the pattern D, being adjacent the cool substrate 28 and at a mass density and temperature corresponding to the left end of the graph (A) in FIG. 3, is cooler and lower in density than the intermediate portion of the deposit E formed by the center of the pattern D. The intermediate deposit portion, at a mass density and temperature corresponding to the middle D(C) of the graph (A), is also protected from gas impingement and thus remains hotter and more liquid tending to trap bubbles of gas. On the other hand, the outer portion of the deposit E formed by the trailing region D(T) of the spray portion D is at a mass density and temperature corresponding to the right end D(T) of the graph (A). Like the inner portion of the deposit E, the outer deposit portion is cooler and less dense than the intermediate portion due to being composed of particles which have travel further before deposit and which make up the fringe of the spray cone. Also, the outer portion of the deposit E is cooler because it is subject to gas impingement.

To overcome the above problem, the present invention involves modifying the configuration of the prior art symmetrical gas-atomizing device 20 of FIG. 1 to that of the improved asymmetrical gas-atomizing device 34 of FIG. 2. Instead of the plurality of jets 20A arranged in the prior art annular configuration about the molten metal stream C, now one or more jets 34A are provided only at one side of the molten metal stream C and disposed at an inclined angle relative to the center axis of the stream. Such modification in the atomizing device configuration will bring about a change of the prior art spray pattern D to a spray pattern G of gas-atomized metal particles having a temperature (and also a comparable mass density) distribution or profile resembling that of graph (B) of FIG. 3.

Hence, the one-sided shear forces generated by the asymmetrically-positioned jet 34A produce a spray cone G providing a higher fraction of liquid in the initial deposits, thus promoting minimal porosity. Such temperature and mass density distribution of the gas-atomized metal particles in the spray cone G will result in an improved, more uniform, distribution of temperature through the cross-section of the deposit H and reduced bottom surface porosity in the deposit.

The asymmetrical gas-atomizing device of the present invention thus produces divergent spray pattern G whose central axis I projects angularly away from the central axis of the vertical stream. As a result of gravity, with the asymmetrical gas-atomizing device 34 more molten metal particles will segregate to the bottom, or leading peripheral region G(L), of the spray cone or pattern G, resulting in the higher fraction of liquid in the initial deposits and closer to the substrate than in the center and trailing peripheral regions G(C), G(T) of the spray pattern G and also than with the prior art symmetrical gas-atomizing device 20, as represented by the left end of the graph (B) compared to the center and right end thereof in FIG. 3.

The upper run 32 of the substrate 28 can have an orientation relative to the spray pattern G as depicted in either FIG. 2 or FIG. 4. In either orientation, due to the higher density and temperature of metal particles in the leading region of the spray cone G a more uniform temperature distribution is achieved through inner, intermediate and outer cross-sectional portions of the deposit H and a reduction of porosity is achieved in the inner portion of the deposit.

More particularly, in the arrangement shown in FIG. 2, the deposit-receiving area 32A of the substrate upper run 32 is orientated in a linear, inclined configuration relative to a horizontal plane, with the substrate moving in an upwardly direction as indicated by the arrow in FIG. 2. The central axis I of the divergent spray pattern G is inclined with respect to the vertical as shown and may be normal to the deposit-receiving area 32A. With this arrangement, the distance required for the leading and trailing regions of the spray pattern G to reach the substrate may be about the same. However, the larger, more molten droplets will tend to segregate to the bottom edge of the pattern (the leading edge) thereby providing a higher fraction of liquid in the initial deposits.

In the arrangement shown in FIG. 4, the deposit-receiving area of the substrate 28 is orientated in a linear horizontal configuration and moves in a direction indicated by the arrow. The central axis I of the divergent spray pattern G is inclined with respect to the vertical as shown. This arrangement results in the leading edge or region of the spray pattern G being closer to the substrate 28 than the trailing edge. With this arrangement there is a shorter distance for the hotter particles to reach the substrate 28 during the initial phase of the deposits thereby further increasing the relative fraction of liquid in the initial deposit.

With the configuration set forth herein, the leading, center and trailing portions of the spray pattern are placed one on top of the other on the moving substrate to form, respectively, the bottom, intermediate and upper portions of the deposit H to form the strip J. The bottom portion of the deposit is disposed closest to, and the upper portion farthest from, the substrate, with the intermediate position therebetween. The higher fraction of particles in the leading edge of the spray and the shortened distance of travel to the upstream portion of the substrate area 32A makes more and higher temperature particles available, providing a higher fraction liquid in the inner portion of the deposit H thus promoting minimal porosity.

Additionally, it has been found that with an asymmetrical gas-atomizing device of the type described herein, the porosity of the individual particles of the spray pattern have less gas porosity than particles produced with the prior art symmetrical gas-atomizing device. As a result, the overall gas porosity of the deposit throughout its cross section is substantially reduced or eliminated.

The U.S. and Foreign patents and applications mentioned in the specification are intended to be incorporated herein by reference in their entirety.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

What is claimed:

1. In a molten metal gas-atomizing spray-depositing apparatus, the combination comprising:

(a) means for producing a stream of molten metal;

(b) means for asymmetricaly atomizing the molten metal stream into a divergent spray pattern of metal particles having a central region and leading and trailing peripheral regions on opposite sides of the center region such that the metal particles in the spray pattern at said leading peripheral region are of higher mass density than at said center and trailing peripheral regions; and (c) means movable relatively to said spray pattern and having an area therein for receiving a deposit of the metal particles, said deposit receiving area being oriented relative to said spray pattern to initially receive the metal particles of higher mass density in the leading peripheral portion thereof.

2. The apparatus as recited in claim 1, wherein said asymmetrical atomizing means includes at least one gas-atomizing jet disposed at one side of the molten metal stream.

3. The apparatus as recited in claim 2, wherein said jet is disposed at an inclined angle relative to a center axis of the molten metal stream for producing the spray pattern having a central axis projecting angularly away from the center axis of the stream.

4. The apparatus as recited in claim 1, wherein said atomizing means is disposed relative to the molten metal stream for producing asymmetrical shear forces against one side of the stream.

5. The apparatus as recited in claim 1, further comprising:

(c) means movable along an endless path and in a direction generally normal to a central axis of said spray pattern for receiving a deposit of the metal particles in said spray pattern to form a product on said movable means.

6. The apparatus as recited in claim 1, further comprising:

(c) means movable along an endless path and in a direction generally inclined to a central axis of said spray pattern for receiving a deposit of the metal particles in said spray pattern to form a product on said movable means.

7. The apparatus as recited in claim 1, further comprising:

(c) means movable along an endless path and having an area thereon for receiving a deposit of the metal particles, said deposit-receiving area of said movable means being oriented relative to said spray pattern to initially receive the metal particles of higher mass density in said leading peripheral portion thereof whereby a bottom surface of the deposit has reduced porosity.

8. In a molten metal gas-atomizing spray-depositing apparatus, the combination comprising:

(a) means for producing a stream of molten metal;

(b) means for asymmetrically gas-atomizing the molten metal stream into a divergent spray pattern of metal particles having a central region and leading and trailing peripheral regions on opposite sides of the center region such that the metal particles in the spray pattern at said leading peripheral region are of higher mass density than at said center and trailing peripheral regions, said asymmetrical atomizing means including at least one gas-atomizing jet disposed at one side only of the molten metal stream; and (c) means movable along an endless path and having an area thereon for receiving a deposit of the metal particles in said spray pattern thereof, said deposit-receiving area of said movable means being oriented relative to said spray pattern to initially receive the metal particles of higher mass density in said leading peripheral portion thereof whereby a bottom surface of the deposit has reduced porosity.

9. The apparatus as recited in claim 8, wherein said jet is disposed at an inclined angle relative to a center axis of the molten metal stream for producing the spray pattern having a central axis projecting angularly away from the center axis of the stream.

10. The apparatus as recited in claim 8, wherein said atomizing means is disposed relative to the molten metal stream for producing asymmetrical shear forces against one side of the stream.

11. The apparatus as recited in claim 8, wherein said movable means is movable along the endless path in a direction generally normal to central axis of said spray pattern.

12. The apparatus as recited in claim 8, wherein said movable means is movable along the endless path in a direction generally inclined to a central axis of said spray pattern.

13. In a molten metal gas-atomizing spray-depositing method, the combination comprising the steps of:

(a) producing a stream of molten metal;

(b) asymmetrically atomizing the molten metal stream into a divergent spray pattern of metal particles having a central region and leading and trailing peripheral regions on opposite sides of the center region such that the metal particles in the spray pattern at said leading peripheral region are of higher mass density than at said center and trailing peripheral regions; and (c) moving a substrate relative to said spray pattern for receiving a deposit of the metal particles, said substrate being oriented relative to said spray pattern to initially receive the metal particles of higher mass density in the leading edge thereof.

14. The method as recited in claim 13, wherein said atomizing includes producing asymmetrical shear forces against one side of the stream.

15. The method as recited in claim 14, wherein said atomizing includes directing the shear forces at an inclined angle to a center axis of the molten metal stream.

16. The method as recited in claim 13, further comprising the step of:

(c) moving a substrate along an endless path and relative to said spray pattern for receiving a deposit of the metal particles in said spray pattern to form a product on said substrate, said substrate being oriented relative to said spray pattern to initially receive the metal particles of higher mass density in said leading peripheral portion thereof whereby a bottom surface of the deposit has reduced porosity.

17. The method as recited in claim 16, wherein said substrate is moved in a direction generally normal to a central axis of said spray pattern.

18. The method as recited in claim 16, wherein said substrate is moved in a direction generally inclined to a central axis of said spray pattern.

19. The method of claim 18 wherein said substrate is moved in a direction normal to the center axis of the molten stream.

* * * * *